US006550699B2

(12) United States Patent
Nagai et al.

(10) Patent No.: US 6,550,699 B2
(45) Date of Patent: Apr. 22, 2003

(54) SOLENOID VALVE AND FUEL INJECTOR USING SAME

(75) Inventors: Koichi Nagai, Toyoake (JP); Masayoshi Ito, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/824,789

(22) Filed: Apr. 4, 2001

(65) Prior Publication Data

US 2001/0028005 A1 Oct. 11, 2001

(30) Foreign Application Priority Data

Apr. 11, 2000 (JP) ..... 2000-108985

(51) Int. Cl.[7] ..... B05B 1/30; F02M 51/00

(52) U.S. Cl. ..... 239/585.1; 239/585.2; 239/585.3; 239/585.4; 239/585.5

(58) Field of Search ..... 239/585.1, 585.2, 239/585.3, 585.4, 585.5; 251/129.15, 129.18, 129.21, 129.16, 50, 54; 335/256, 251, 268

(56) References Cited

U.S. PATENT DOCUMENTS 4,327,345 A * 4/1982 Kelso et al. ..... 335/265
4,568,021 A * 2/1986 Deckard et al. ..... 239/88
5,139,224 A * 8/1992 Bright ..... 251/50
5,341,994 A * 8/1994 Wakeman ..... 239/585.5
6,027,037 A 2/2000 Murakami et al.

FOREIGN PATENT DOCUMENTS

JP 10-153155 6/1998

* cited by examiner

*Primary Examiner*—Michael Mar
*Assistant Examiner*—Davis Hwu
(74) *Attorney, Agent, or Firm*—Nixon & Vanderhye, P.C.

(57) ABSTRACT

A solenoid valve is provided which may be used to inject fuel into an internal combustion engine for automotive vehicles. The solenoid valve is designed to keep an air gap between a stator and an armature at a constant interval required to ensure a normal operation of the solenoid valve. The solenoid valve includes a spacer which is provided between the stator and the armature to keep the air gap without any hit of the armature on the stator. In one embodiment, the spacer is installed on a peripheral portion of the stator or the armature.

11 Claims, 7 Drawing Sheets

SOLENOID VALVE AND FUEL INJECTOR USING SAME

BACKGROUND OF THE INVENTION

1. Technical Field of the Invention

The present invention relates generally to a solenoid valve and a fuel injector which may be used to inject fuel into an internal combustion engine for automotive vehicles, and more particularly to a simple and compact structure of a solenoid valve designed to keep an air gap between a stator and an armature at a constant interval required to ensure a normal operation of the solenoid valve and a fuel injector using the same.

2. Background Art

In general, a solenoid valve is used in fuel injectors for internal combustion engines. In order to avoid a failure in operation of the solenoid valve caused by residual magnetism or remanence after the supply of current to a coil is cut off, an air gap is provided between a stator and an armature. In the following discussion, a clearance remaining between a stator and an armature after a valve member is lifted up fully will be referred to as an air gap.

U.S. Pat. No. 6,027,037, issued on Feb. 22, 2000, assigned to the same assignee as that of this application discloses a solenoid valve used in an accumulator fuel injection apparatus for diesel engines which is schematically illustrated in FIG. 7.

An armature disk 104 has a protrusion 103 projecting from the center thereof to a stator 101 to form an air gap H between the armature disk 104 and the stator 101. A needle valve 107 which is lifted up and down along with the armature disk 104 is supported by a radial bearing 105 installed in a housing 106.

The above structure, however, needs to minimize the play of the needle valve 107 in order to ensure the air gap H required to avoid the failure in operation of the solenoid valve due to the remanence by designing the bearing 105 to be long and machining the bearing 105 and the needle valve 107 accurately so that the clearance therebetween will fall within a range of 5 to 10 $\mu$m. The increase in length of the bearing 105 will result in an increase in overall size of the solenoid valve. The accurate machining of the bearing 105 and the needle valve 107 will increase manufacturing costs of the solenoid valve.

Moreover, because of a small height of the protrusion 103, a shift in reciprocating path of the needle valve 107 and the armature 104 may cause an outer edge of the armature 104 to hit on the bottom of the stator 101 when the armature 104 is attracted by the stator 101, thereby resulting in a variation in air gap H in the circumferential direction of the armature 104, which will contribute to a failure in operation of the solenoid 102.

SUMMARY OF THE INVENTION

It is therefore a principal object of the invention to avoid the disadvantages of the prior art.

It is another object of the invention to provide a small-sized solenoid valve designed to ensure the air gap between an armature and a stator with simple arrangements and a fuel injecting apparatus using the same.

According to one aspect of the invention, there is provided a solenoid valve which may be used in a fuel injector for automotive vehicles. The solenoid valve comprises: (a) a housing in which a valve hole is formed for blocking and establishing fluid communication between an upstream and a downstream portion of a fluid passage; (b) a valve member disposed in the housing slidably to close and open the valve hole selectively; (c) an armature connected to the valve member to be movable along with the valve member; (d) a stator disposed within the housing, the stator working to attract the armature in a direction to open the valve hole; (e) a coil producing a magnetic attractive force through the stator when energized; and (f) a spacer provided between the stator and the armature to keep a given air gap therebetween without any hit of the armature on the stator, the spacer being provided on a peripheral portion of one of the stator and the armature.

In the preferred mode of the invention, the spacer is made of the same material as that of at least a portion of the armature and formed integrally with the armature in an annular form.

The spacer may also be made of a solid film harder than the armature and fixed on the peripheral portion of the armature.

The spacer may alternatively be made up of a plurality of discrete members disposed on the peripheral portion of the armature.

The spacer may alternatively be made of the same material as that of at least a portion of the stator and formed integrally with the stator in an annular form.

The spacer may alternatively be made of a solid film harder than the stator and fixed on the peripheral portion of the stator.

The spacer may alternatively be made up of a plurality of discrete members disposed on the peripheral portion of the stator.

A bearing member may further be provided which supports the valve member slidably.

According to another aspect of the invention, there is provided a fuel injector which may be used to inject fuel into an internal combustion engine for automotive vehicles. The fuel injector comprises: (a) a nozzle valve working to open and close a spray hole selectively; (b) a nozzle body supporting the nozzle valve slidably; (c) a pressure chamber producing therein a fuel pressure working to urge the nozzle valve in a spray hole-closing direction; and (d) a solenoid valve working to control the fuel pressure in the pressure chamber. The solenoid valve comprises a housing in which a valve hole is formed for blocking and establishing fluid communication between an upstream and a downstream portion of a fluid passage, a valve member disposed in the housing slidably to close and open the valve hole selectively, an armature connected to the valve member to be movable along with the valve member, a stator disposed within the housing, working to attract the armature in a direction to open the valve hole, a coil producing a magnetic attractive force through the stator when energized, and a spacer provided between the stator and the armature to keep a given air gap therebetween without any hit of the armature on the stator. The spacer is provided on a peripheral portion of one of the stator and the armature.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 3(*b*) is a partial sectional view which shows a modification of the spacer of FIG. 3(*a*);

FIG. 4(*c*) shows a comparative example of a spacer;

DESCRIPTION OF THE PREFERRED EMBODIMENTS

Figure 1:
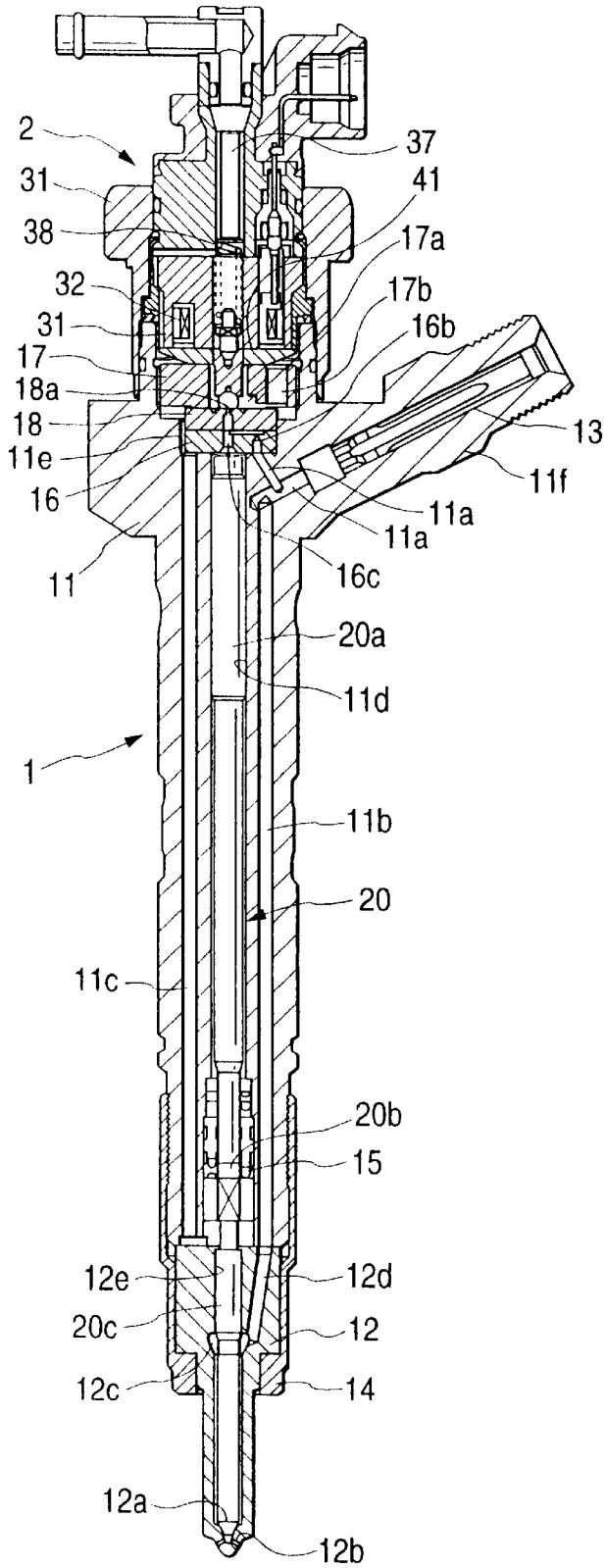
FIG. 1 is a vertical sectional view which shows a fuel injector equipped with a solenoid valve according to the first embodiment of the invention.
Figure 2:
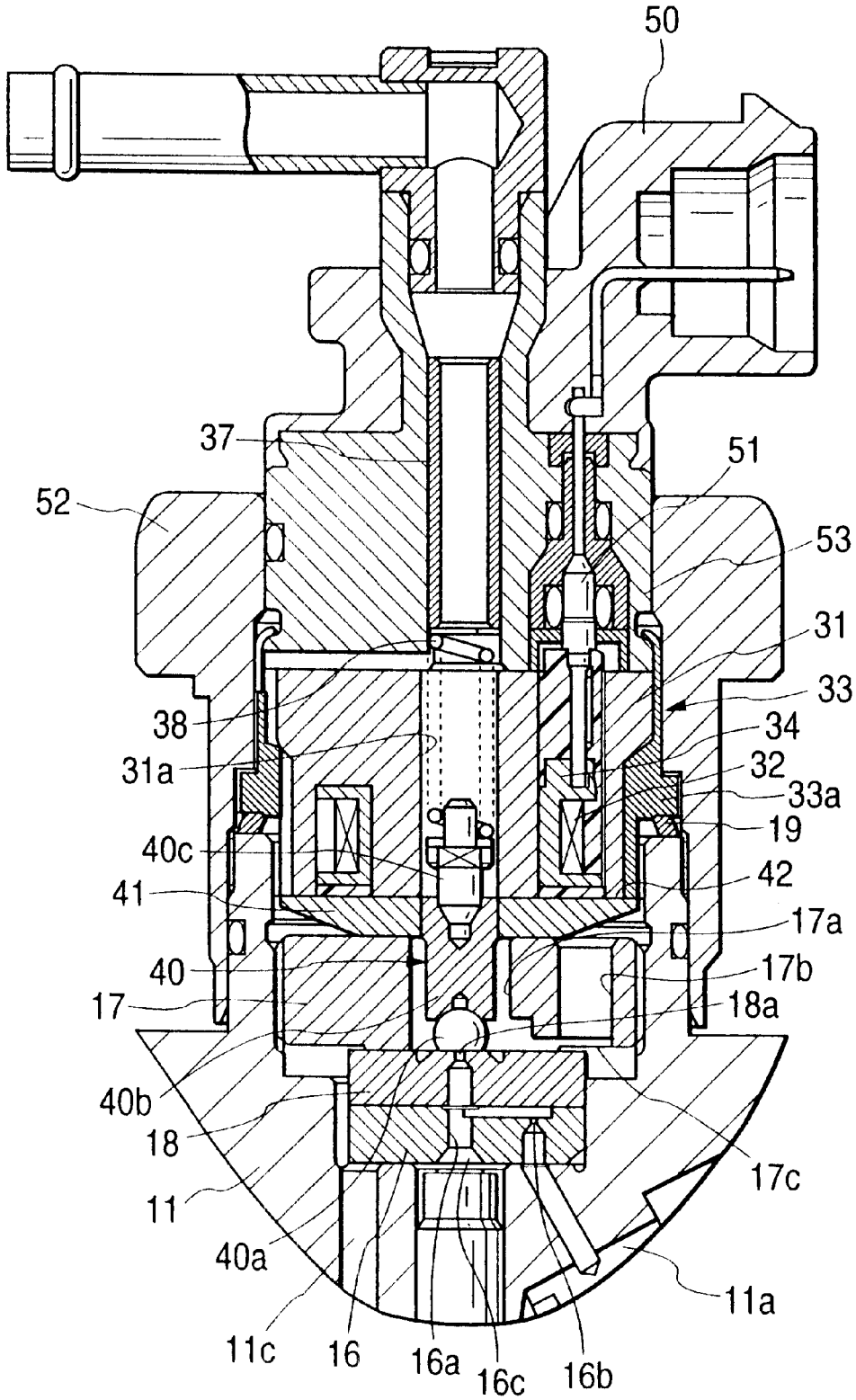
FIG. 2 is a partial sectional view which shows an internal structure of the solenoid valve installed in the fuel injector of FIG. 1.

Referring to the drawings, wherein like reference numbers refer to like parts in several views, particularly to FIGS. 1 and 2, there is shown a fuel injector 1 according to the invention.

The fuel injector 1 is installed in a head of an internal combustion engine (not shown) and inject fuel directly into one of cylinders of the engine.

The fuel injector 1 includes a housing 11 (i.e., an injector body) and a nozzle body 12 which are joined by a retaining nut 14.

The housing 11 has a needle chamber 11*d* formed therein. Similarly, the nozzle body 12 has a needle chamber 12*e* formed therein. A nozzle valve 20 is disposed within the needle chambers 11*d* and 12*e*.

The housing 11 has an inlet 11*f* which works as a connector to a fuel pump (not shown) The inlet 11*f* has a fuel inlet passage 11*a* formed therein. A bar filter 13 is installed in the fuel inlet passage 11*a*. The fuel inlet passage 11*a* communicates with a fuel passage 12*d* formed in the nozzle body 12 through a fuel passage 11*b*. The fuel passage 12*d* communicates with the needle chamber 12*e* through a fuel sump 12*c*. The needle chamber 12*e* communicates with spray holes 12*b* formed in a head of the nozzle body 12. The fuel supplied from the fuel pump to the inlet 11*f* flows through the bar filter 13 to the fuel inlet passage 11*a*, the fuel passages 11*b* and 12*d*, the fuel sump 12*c*, and the needle chamber 12*e* and is injected from the spray holes 12*b* into a cylinder of the engine. The housing 11 also has a leak passage 11*c* leading to the needle chamber 11*d*.

The nozzle valve 20 consists of a needle 20*c*, a rod 20*b*, and a control piston 20*a*. The needle 20*c* is made up of a seating portion (i.e., a valve head), a small-diameter portion, a tapered portion, and a large-diameter portion. The large-diameter portion is disposed hermetically within the needle chamber 12*e* to be movable in a lengthwise direction of the nozzle valve 20. The tapered portion is urged upward, as viewed in FIG. 1, by the fuel pressure in the fuel sump 12*c*. An annular gap is formed between an outer wall of the small-diameter portion and an inner wall of the needle chamber 12*e*. The seating portion is of a conical shape and rests on a valve seat 12*a* to close the spray holes 12*b*. The rod 20*b* abuts at one end on the needle 20*c* and at the other end on the control piston 20*a*. A coil spring 15 is disposed around the rod 20*b* and urges the needle 20*c* through the rod 20*b* into constant engagement with the valve seat 12*a*. The control piston 20*a* is disposed slidably within the needle chamber 11*d* hermetically to be movable in the lengthwise direction thereof.

A first annular plate 16, as shown in FIG. 2, is disposed within a cylindrical end chamber which is formed in an end portion of the housing 11 in communication with an upper end of the needle chamber lid. The first plate 16 has formed therein an outlet orifice 16*a* leading to the needle chamber 11*d* and an inlet orifice 16*b* communicating between the outlet orifice 16*a* and the fuel inlet passage 11*a* through a fuel passage 11*g*. A pressure chamber 16*c* is defined by the end of the control piston 20*a*, the inner wall of the needle chamber 11*d*, and an inner wall of the outlet orifice 16*a*.

A second annular plate 18 and a third annular plate 17 are laid on the first plate 16 to overlap each other. The third plate 17 is screwed into the end chamber of the housing 11 to hold the first plate 16 and the second plate 18 therewithin. The third plate 17 has through holes 17*a* and 17*b* formed therein. The through hole 17*a* defines a valve chamber. The second plate 18 has formed therein a valve hole 18*a* which establishes communication between the pressure chamber 16*c* and the through hole 17*a*. A clearance 11*e* is, as clearly shown in FIG. 1, formed in a circumferential direction between side walls of the first and second plates 16 and 18 and the inner wall of the end chamber of the housing 11. The clearance 11*e* leads to the leak passage 11*c* and to the holes 17*a* and 17*b* through a recess 17*c* formed in a surface of the third plate 17 facing the second plate 18.

The fuel injector 1 also has a solenoid valve 2. The solenoid valve 2 has a stator 31 disposed within a hollow cylindrical casing 33. The casing 33 has a flange 33*a* which is held between an inner step of a retaining nut 52 and the end of the housing 11 through an annular member 19 to join the casing 33 to the housing 11. The casing 33 has an upper opening closed by an end body 53. The end body 53 is joined at an end surface thereof to an end surface of the stator 31 firmly by bending an upper edge of the casing 33 inwardly, thereby holding the stator 31 within the casing 33. In the stator 31, a bobbin 34 and a coil 32 wound around the bobbin 34 are fixed through resin. The coil 32 leads electrically to a terminal 51 extending into a connector 50.

A control valve 40 is disposed slidably within the stator 31 and the third plate 17. The control valve 40 consists of a spherical member 40*a*, a stem 40*b*, and a spring seat 40*c*. The spherical member 40*a*, the stem 40*b*, and the spring seat 40*c* may be connected together in press-fits or formed by machining a single member. The spherical member 40*a* has a flat surface which works to close the valve hole 18*a*. The stem 40*b* is press fit at a base thereof within a central hole formed in an armature 41 and extends into the hole 17*a* of the third plate 17.

A second coil spring 38 is disposed in a central bore 31*a* formed in the stator 31 between an end of a spring pressure-adjusting pipe 37 forced into the end body 53 and the spring seat 40*c* to urge the spherical member 40*a* into constant engagement with the second plate 18 through the stem 40*b* to close the valve hole 18*a*.

Figure 3A:
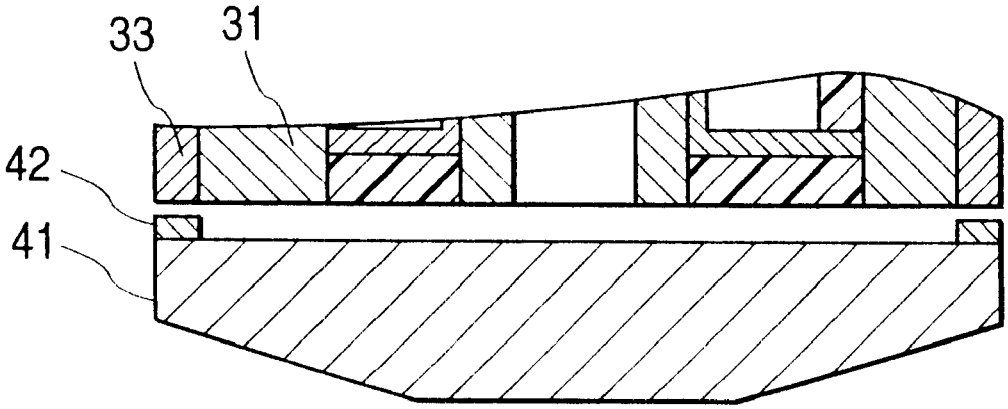
FIG. 3(*a*) is a partial sectional view which shows a spacer working to keep an air gap between an armature and a stator.
Figure 3B:
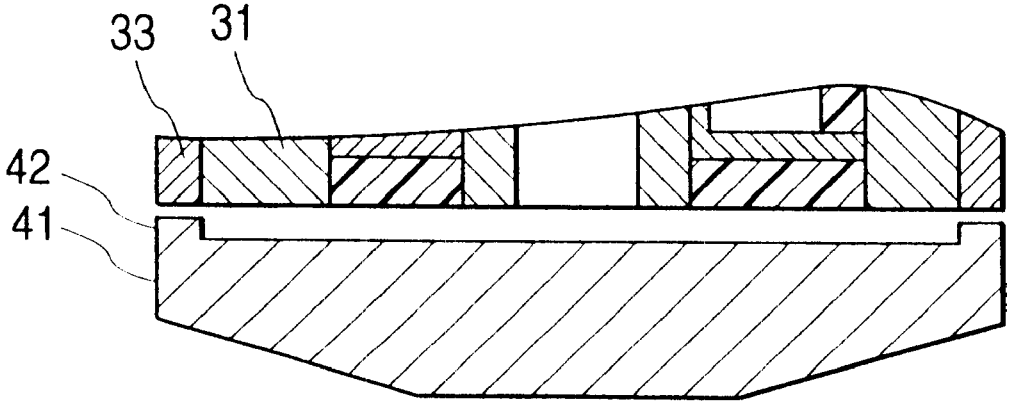

The armature 41 is made of a magnetic disk and disposed slidably between the third plate 17 and the stator 31. A ring-shaped spacer 42 is disposed between an edge portion of the surface of the armature 41 facing the stator 31. The spacer 42 is made of, for example, a hard chrome film or a hard nickel-phosphate film and may be, as shown in FIG. 3(*a*), formed on the surface of the armature 41 using wet plating techniques or dry plating techniques such as evaporation or adhered to the surface of the armature 41 after being machined. The spacer 42 may alternatively be formed, as shown in FIG. 3(*b*), by machining the surface of the armature 41.

Figure 4A:
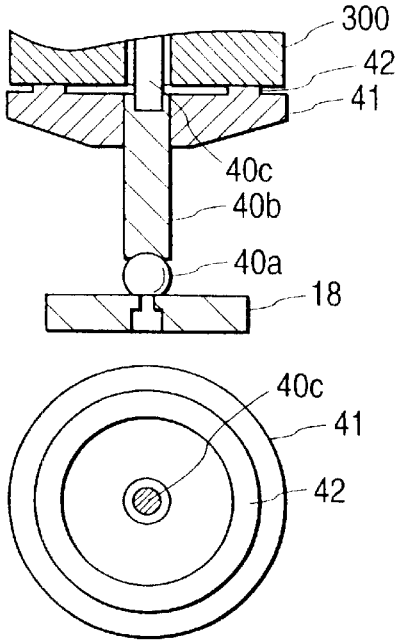
FIGS. 4(*a*) and 4(*b*) show modified forms of a spacer as shown in FIG. 2.
Figure 4B:
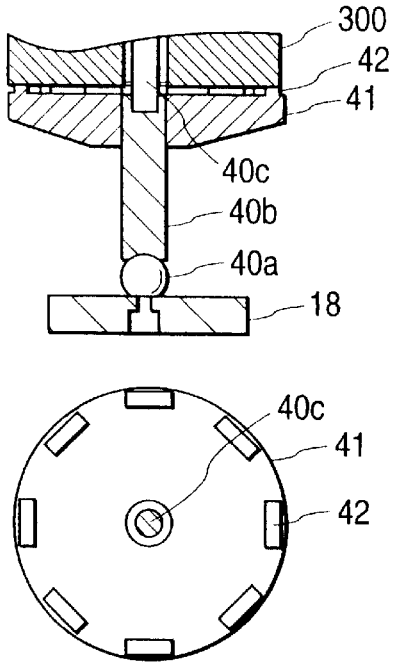
Figure 4C:
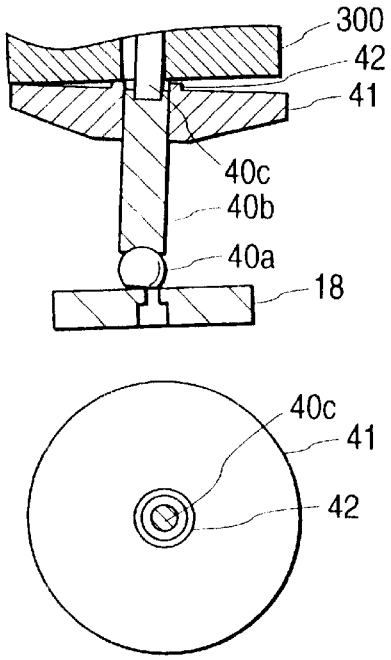
Figure 5A:
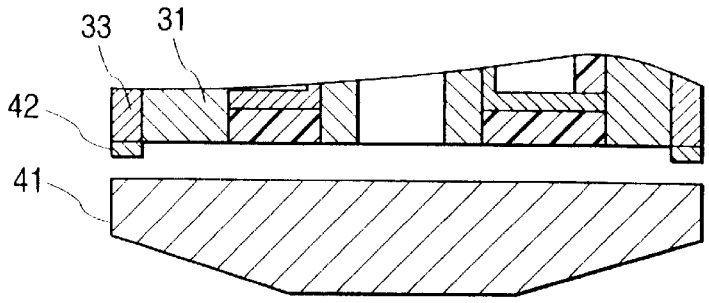
FIGS. 5(*a*), 5(*b*), 5(*c*), and 5(*d*) show modified forms of a spacer as shown in FIG. 2.
Figure 5B:
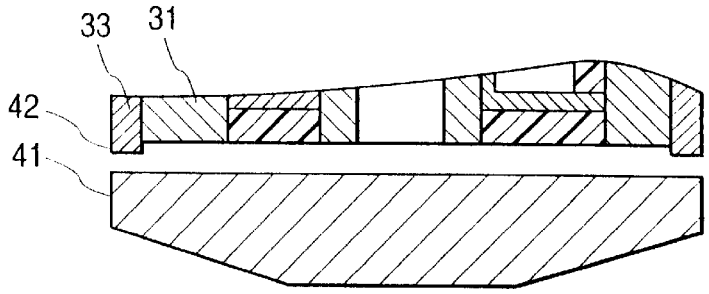
Figure 5C:
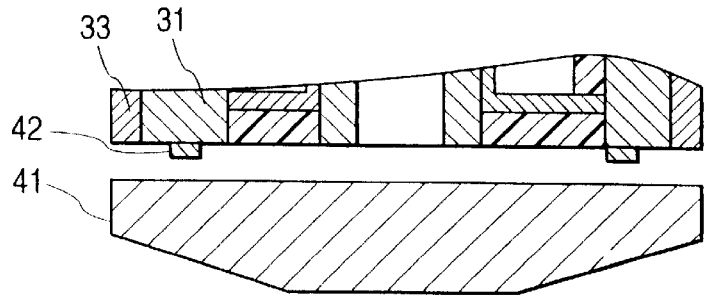
Figure 5D:
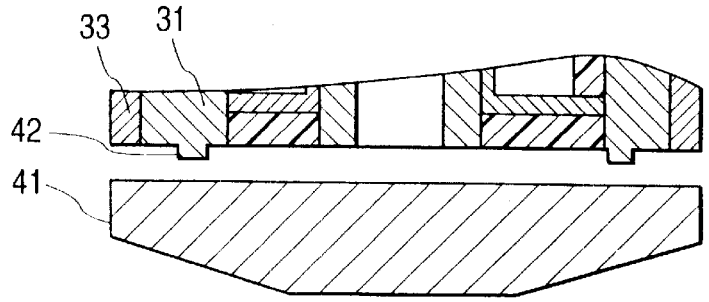

The spacer 42 is, as described above, made of a ring-shaped member which has an inner diameter substantially identical with that of the casing 33 and an outer diameter substantially identical with that of the armature 41, however, not limited in shape and size to the one shown in FIGS. 3(*a*) and 3(*b*) as long as it can keep the air gap between the armature 41 and the stator 31 constant. FIGS. 4(*a*) and 4(*b*) show modifications of the spacer 42. Reference number 300 indicates a body of the stator 31. In FIG. 4(*a*), the spacer 42 has an outer diameter slightly smaller than that of the armature 41. In FIG. 4(*b*), the spacer 42 is made up of rectangular parallelopiped members arrayed in a circle along the periphery of the armature 41. Each of the rectangular parallelopiped members may alternatively be arranged at any location on the armature 41 where it is in contact with the body of the stator 31. Specifically, if the stator 31 is made of a relatively friable material, the spacer 42, as shown in FIG. 3(*a*) or 3(*b*), which is so formed as to be in contact with the casing 31 is useful in terms of the rigidity. Conversely, if the stator 31 is made of an impact-resistive material, the spacer 42, as shown in FIG. 4(*a*) or 4(*b*), which is so formed as to be in contact with the body 300 of the stator 31 is useful. Each of the rectangular parallelopiped members of the spacer 42 of FIG. 4(*b*) is so determined in width, length, and interval from the center of the armature 41 that the periphery of the armature 41 does not hit on the stator 31 directly between adjacent two of the rectangular parallelopiped members.

FIG. 4(*c*) shows a comparative example in which the spacer 42 is unsuitable in location and shape for establishing a desired air gap between the armature 41 and the body 300 of the stator 31. Specifically, the spacer 42 is too small in outer diameter to avoid a hit of the periphery of the armature 41 against the body 300 of the stator 31 when the armature 41 is attracted to the body 300 of the stator 31.

FIGS. 5(*a*) to 5(*d*) show modifications of the spacer 42.

In FIG. 5(*a*), the annular spacer 42 is attached to the bottom of the casing 33. In FIG. 5(*b*), the bottom of the casing 33 projects from the end surface of the stator 31 to define the spacer 42. In FIG. 5(*c*), the spacer 42 whose outer diameter is smaller than that of the armature 41 is attached to the end surface of the stator 31. In FIG. 5(*d*), the spacer 42 is formed by machining the end surface of the stator 31 to form an annular protrusion projecting from the bottom of the casing 33.

A fuel injection operation of the fuel injector 1 will be discussed below.

When it is required to inject the fuel into the internal combustion engine, an ECU (electronic control unit), not shown, actuates a fuel injection pump and delivers the fuel to an accumulator pipe. The fuel is stored in the accumulator pipe at a constant high pressure level and supplied to the fuel injector 1 through a supply pipe connected to the inlet 11*f*.

The ECU produces a control valve-actuating current as a function of an operating condition of the engine and outputs it to the coil 32 of the stator 31 in the form of a pulse signal. When the coil 32 is energized, it will cause the stator 31 to produce an attractive force. When the sum of the attractive force and the fuel pressure within the pressure chamber 16*c* acting on the control valve 40 exceeds the spring pressure of the second spring 38, the armature 41 is attracted to the stator 31, thereby causing the control valve 40 to be lifted upward, as viewed in FIGS. 1 and 2, so that the spherical member 40*a* of the control valve 40 leaves the valve hole 18*a* to open the outlet orifice 16*a*. When the outlet orifice 16*a* is opened, it establishes the fluid communication between the pressure chamber 16*c* and a low-pressure chamber (i.e., the through hole 17*a*), thereby causing the fuel to flow from the pressure chamber 16*c* to the low-pressure chamber. The fuel entering the low-pressure chamber is drained to a fuel tank through the through holes 17*a*, 17*b*, and 31*a*, and the inside of the adjusting screw 37.

When the pressure chamber 16*c* communicates with the low-pressure chamber, it will cause the fuel flowing out of the pressure chamber 16*c* through the valve hole 18*a* to be greater than that flowing into the pressure chamber 16*c* from the inlet orifice 16*b*, so that the fuel pressure within the pressure chamber 16*c* drops. When the fuel pressure in the pressure chamber 16*c* decreases, and the sum of the spring pressure of the first spring 15 and the fuel pressure in the pressure chamber 16*c* urging the needle 20*c* in the spray hole-closing direction overcomes the fuel pressure in the fuel sump 12*c* urging the needle 20*c* in the spray hole-opening direction, it will cause the needle 20*c* to be moved away from the valve seat 12*a* to open the spray holes 12*b*, thereby producing a fuel jet.

When it is required to stop the fuel injection, the ECU deenergizes the coil. 32. When the coil 32 is deenergized, it will cause the attractive force to disappear from the stator 31, so that the spring pressure of the second spring 38 overcomes the fuel pressure in the pressure chamber 16*c* to move the control valve 40 downward, thereby closing the valve hole 18*a* through the spherical member 40*a*. The fuel continues flowing into the pressure chamber 16*c* through the inlet orifice 16*b*, so that the fuel pressure in the pressure chamber 16*c* is elevated. When the sum of the spring pressure of the first spring 15 and the fuel pressure in the pressure chamber 16*c* acting on the needle 20*c* in the spray hole-closing direction overcomes the fuel pressure in the fuel sump 12*c* in the spray hole-opening direction, it will cause the needle 20*c* to move downward, as viewed in FIG. 1, so that the needle 20*c* rests on the valve seat 12*a* to close the spray holes 12*b*, thereby stopping the fuel injection.

When the control valve 40 is attracted by the stator 31, the spacer 42 hits on the casing 33 and stops the movement of the control valve 40. The spacer 42 is, as described above, located away from the center of the armature 41 in a radius direction thereof, so that the armature 41 is kept separated from the stator 31 without hitting on the casing 33 as well as the stator 31, thereby ensuring the desired air gap between the armature 0 and the stator 31.

The clearance between the through hole 17*a* of the third plate 17 and the stem 40*b* of the control valve 40 is relatively great. Specifically, the third plate 17 does not support the stem 40*b* directly, thus allowing tolerances of the through hole 17*a* and the stem 40*b* to be increased, which provides for ease of machining of the through hole 17*a* and the stem 40*b*. The spacer 42 does not hit on the stator 31 directly, thus allowing the stator 31 to be made of a relatively friable material. The reciprocating motion of the control valve 40 is supported by the armature 41, thus allowing the third plate 17 to be decreased in thickness or omitted for decreasing the overall length of the fuel injector 1.

Figure 6:
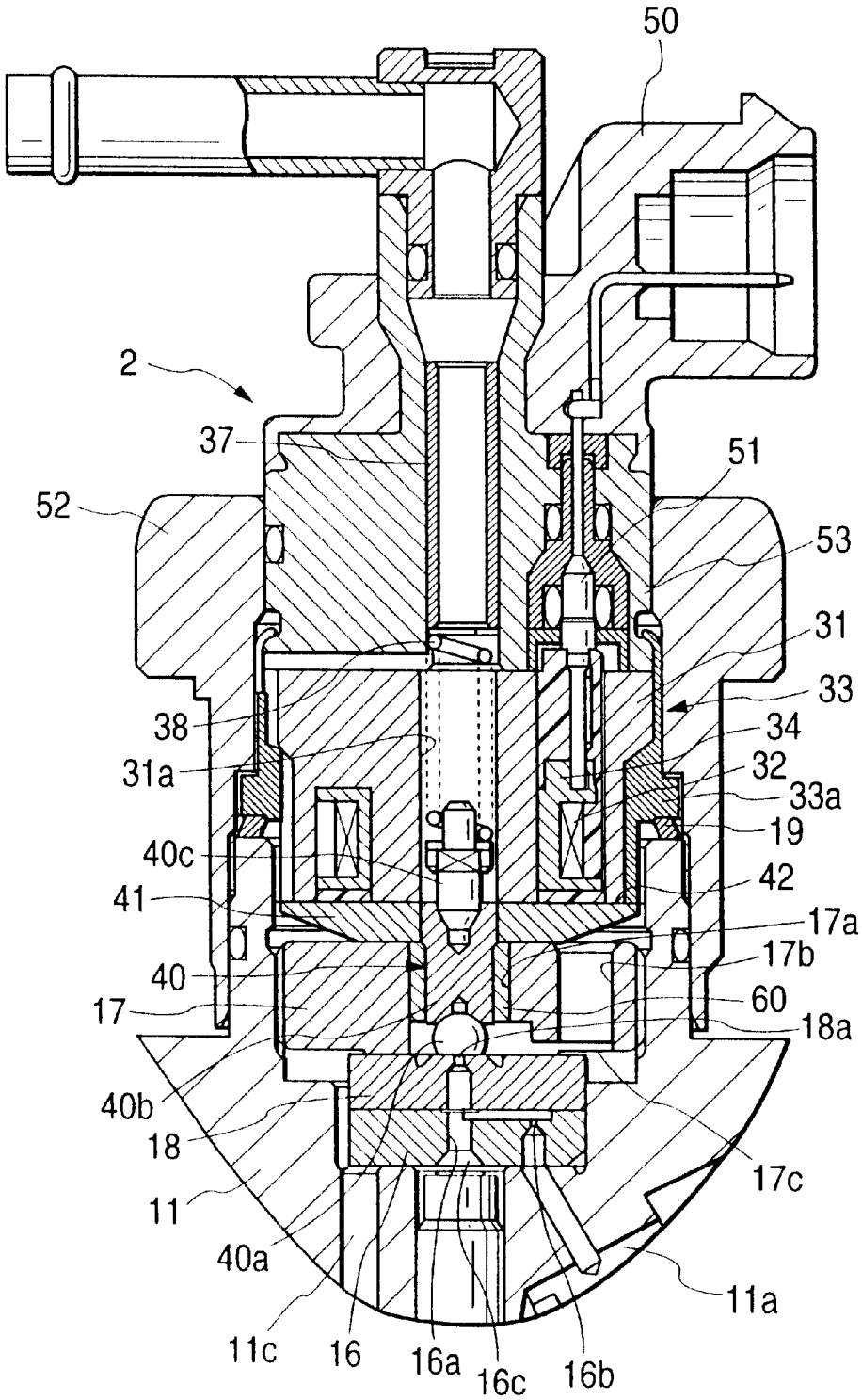
FIG. 6 is a partial sectional view which shows an internal structure of a solenoid valve according to the second embodiment of the invention.
Figure 7:
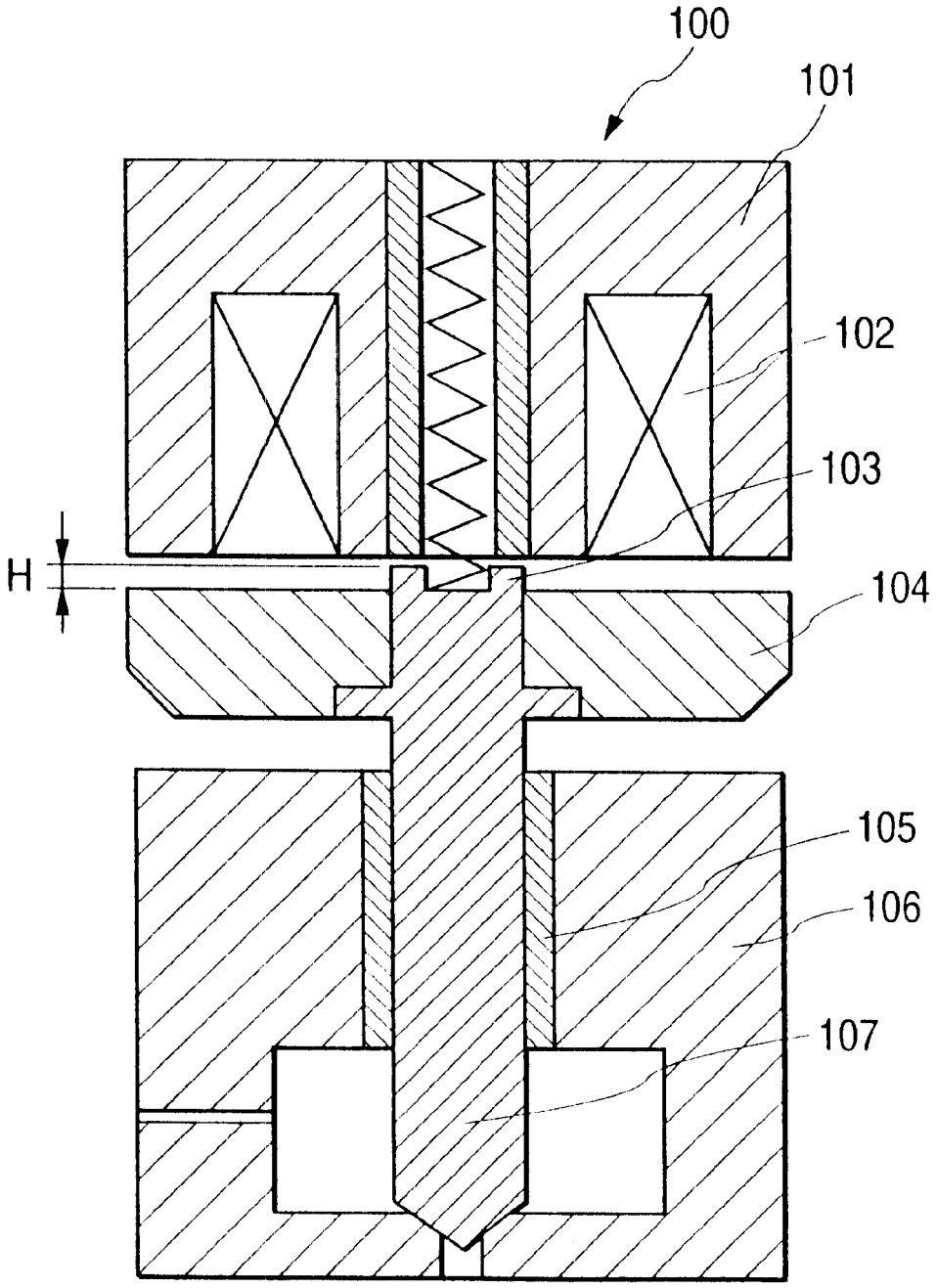
FIG. 7 PRIOR ART
FIG. 7 is a vertical sectional view which shows a conventional solenoid valve.

FIG. 6 shows the solenoid valve 2 according to the second embodiment of the invention which is different from that in the first embodiment only in that a bush 60 is provided which serves as a bearing for the control valve 40. Other arrangements are identical, and explanation thereof in detail will be omitted here.

The bush 60 is formed by a thin-walled hollow cylindrical member made having a relatively high hardness and press fit in the through hole 17*a* of the third plate 17. The clearance between the bush 60*a*nd the stem 40*b* is approximately 100 $\mu$m.

The use of the bush 60 results in a decrease in wear of parts supporting the control valve 40, thereby increasing the overall service life of the fuel injector 1 and also improves the resistance to heavy use of the fuel injector 1 allowing the amount of lift of the control valve 40 to be increased and/or the current energizing the coil 32 to be increased. The spacer 42, like the first embodiment, works by itself to keep the desired air gap between the stator 31 and the armature 41 constant, thus allowing the clearance between the bush 60 and the stem 40*b* to be increased, which provides for ease of machining of the bush 60.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims.

What is claimed is:

1. A solenoid valve comprising:

a housing in which a valve hole is formed for blocking and establishing fluid communication between an upstream and a downstream portion of a fluid passage;

a valve member disposed in said housing slidably to close and open the valve hole selectively;

an armature connected to said valve member to be movable along with said valve member;

a stator disposed within said housing, said stator working to attract said armature in a direction to open said valve hole;

a coil producing a magnetic attractive force through said stator when energized; and a spacer provided between said stator and said armature to keep a given air gap therebetween without any hit of said armature on said stator, said spacer being provided on a peripheral portion of one of said stator and said armature.

2. A solenoid valve as set forth in claim 1, wherein said spacer is made of the same material as that of at least a portion of said armature and formed integrally with said armature in an annular form.

3. A solenoid valve as set forth in claim 1, wherein said spacer is made of a solid film harder than said armature and fixed on the peripheral portion of said armature.

4. A solenoid valve as set forth in claim 2, wherein said spacer is made up of a plurality of discrete members disposed on the peripheral portion of said armature.

5. A solenoid valve as set forth in claim 1, wherein said spacer is made of the same material as that of at least a portion of said stator and formed integrally with said stator in an annular form.

6. A solenoid valve as set forth in claim 1, wherein said spacer is made of a solid film harder than said stator and fixed on the peripheral portion of said stator.

7. A solenoid valve as set forth in claim 5, wherein said spacer is made up of a plurality of discrete members disposed on the peripheral portion of said stator.

8. A solenoid valve as set forth in claim 1, further comprising a bearing member which supports said valve member slidably.

9. A fuel injector comprising:

a nozzle valve working to open and close a spray hole selectively;

a nozzle body supporting said nozzle valve slidably;

a pressure chamber producing therein a fuel pressure working to urge said nozzle valve in a spray hole-closing direction; and a solenoid valve working to control the fuel pressure in said pressure chamber, said solenoid valve including (a) a housing in which a valve hole is formed for blocking and establishing fluid communication between an upstream and a downstream portion of a fluid passage;

(b) a valve member disposed in said housing slidably to close and open the valve hole selectively;

(c) an armature connected to said valve member to be movable along with said valve member;

(d) a stator disposed within said housing, said stator working to attract said armature in a direction to open said valve hole;

(e) a coil producing a magnetic attractive force through said stator when energized; and (f) a spacer provided between said stator and said armature to keep a given air gap therebetween without any hit of said armature on said stator, said spacer being provided on a peripheral portion of one of said stator and said armature.

10. A solenoid valve comprising:

a housing in which a valve hole is formed for blocking and establishing fluid communication between an upstream and a downstream portion of a fluid passage;

a valve member slidably disposed in said housing to selectively open and close the valve hole, there being a clearance between the valve member and an inner wall of the housing;

an armature connected to said valve member, said armature being movable along with said valve member;

a stator disposed within said housing, said stator working to attract said armature in a direction to open said valve hole;

a coil producing a magnetic attractive force through said stator when energized; and a spacer provided between said stator and said armature to provide a given air gap therebetween without any hit of said armature on said stator, said spacer being provided on a peripheral portion of one of said stator and said armature, wherein said clearance is configured to allow said armature to be inclined with respect to said stator when the armature is attracted by the magnetic attractive force to said stator.

11. A solenoid valve as set forth in claim 10, wherein said clearance is approximately 100 $\mu$m.

* * * * *